United States Patent [19]

de Leeuw

[11] 3,942,916

[45] Mar. 9, 1976

[54] DOSING DEVICE PARTICULARLY FOR SMALL QUANTITIES OF LIQUID

[75] Inventor: Jan de Leeuw, Akersberga, Sweden

[73] Assignee: Autochem Instrument AB, Lidingo, Sweden

[22] Filed: Feb. 5, 1974

[21] Appl. No.: 440,090

[52] U.S. Cl. ..... 417/568; 137/525

[51] Int. Cl.[2] ..... F04B 21/02

[58] Field of Search ..... 137/525, 512; 417/458, 417/566, 568; 251/61, 61.1

[56] References Cited

UNITED STATES PATENTS

| | | | |
|---|---|---|---|
| 1,402,082 | 1/1922 | Moran | 137/525 |
| 2,211,212 | 8/1940 | Langdon | 137/512 |

FOREIGN PATENTS OR APPLICATIONS

| | | | |
|---|---|---|---|
| 457,220 | 11/1936 | United Kingdom | 417/566 |
| 4,479 | 1/1916 | United Kingdom | 417/566 |

*Primary Examiner*—Robert B. Reeves
*Assistant Examiner*—Larry H. Martin
*Attorney, Agent, or Firm*—Larson, Taylor and Hinds

[57] ABSTRACT

A dosing device for dispensing very small quantities of liquid includes a variable displacement piston for varying the pressure within a chamber and valves located in inlet and outlet ducts communicating with the chamber. The valves preferably comprise a disc having a circular periphery and including passages therein which are radially spaced from the central portion of the disc. This central portion engages a valve seat to close off the corresponding duct and is preferably rigid to prevent permanent deformation of the disc. The peripheral edges of the disc are received in an annular groove and are free to move radially therein.

2 Claims, 1 Drawing Figure

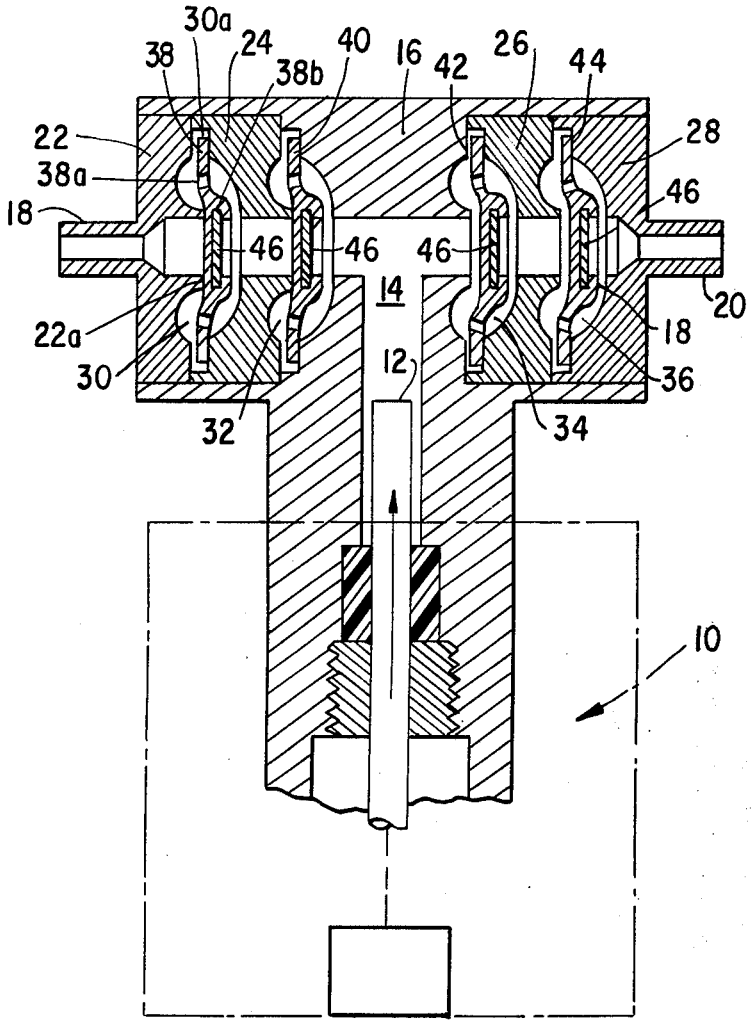
30a
24
38
38b
40
16
42
26
44
22
28
38a
46
18
46
46
46
14
20
22a
18
30
12
36
32
34
10

DOSING DEVICE PARTICULARLY FOR SMALL QUANTITIES OF LIQUID

FIELD OF THE INVENTION

The present invention relates to a dosing or dispensing device particularly adapted to dispense small quantities of liquid.

BACKGROUND OF THE INVENTION

Recent developments in the analysis of liquids emphasize automation and the use of so-called "micromethods". However, the automation of liquid analysis techniques using very small quantities of liquid, i.e., quantities of the order magnitude of a few microliters, has been limited because of difficulities in measuring out these small quantities with high reproducibility.

The limitations on these dosing techniques can be traced largely to the valves used in the dosing devices. Most of the valves in dosing devices of this type utilize a valve body in the form of a cone or ball which seals against a corresponding valve seat under forces generated by gravity, hydraulic pressure or mechanical biassing devices such as springs. The reproducibility afforded by the devices is poor for small quantities of liquid because of factors such as friction, leakage, wear and the strong resistance to opening provided by some of the valves of this type.

SUMMARY OF THE INVENTION

In accordance with the present invention, a dosing device is provided which overcomes the disadvantages of the prior art dosing devices discussed above.

In accordance with a preferred embodiment thereof, the dosing device of the invention comprises a housing including a variable displacement device such as a piston-type displacement pump for varying the pressure within a chamber which communicates with inlet and outlet ports through valved ducts, at least one of the valves comprising a disc having a circular outer periphery, intermediate passages therethrough and a central portion which rests against a corresponding valve seat in the closed position of the valve. The perpherical edges of the disc are received in an outer annular groove and are of thickness which is less then the axal width of the groove so that the disc can move radially. The central portion of the disc is preferably rigid so as to prevent deformation of the disc while the outer edges are flexible.

Other features and advantages of the invention will be set forth in, or apparent from, the detailed description of preferred embodiment found therein below.

BRIEF DESCRIPTION OF THE DRAWINGS

The single FIGURE shown in the drawings is a transverse sectional view of a dosing device in accordance with a preferred embodiment of the invention.

DESCRIPTION OF THE PREFERRED EMBODIMENTS

Referring to the single FIGURE in the drawings, a dosing device is shown which includes a variable displacement pump, shown schematically at 10, which drives a displacement piston 12 within a pump chamber 14. The pump chamber 14 is formed within a valve housing 16 which includes an inlet port 18 and an outlet port 20. Valve housing 16 includes first and second annular members or rings 22 and 24 on the inlet side thereof and third and fourth rings 26 and 28 on the outlet side thereof. Central apertures of passageways in rings 22 and 24 form portions of an inlet duct to chamber 14 while corresponding apertures in rings 26 and 28 form portions of an outlet duct. Rings 22 and 24 are shaped so as to form a space or cavity 30 therebetween, ring 24 forming a similarly shaped cavity 32 with a corresponding portion of the remainder of the valve housing 16, as illustrated. Rings 26 and 28 serve in forming similar cavities 34 and 36 at the outlet side.

A series of four discs 38, 40, 42 and 44 are respectively located in corresponding cavities 30, 32, 34 and 36. Considering disc 38 as exemplary, disc 38 acts as a valve body within cavity 30 in cooperation with a seat 22a formed on ring 22. Disc 38 includes throughholes or apertures 38a which permit the passage of liquid through a portion thereof which is radially spaced from the valve seat 22a. Rings 22 and 24 are shaped so that cavity 30 includes an outer annular groove **30*a* in which the peripheral edge of the disc 38 is received. The width of groove 30*a* in a direction parallel to the longitudinal axis of the housing 16 is greater than the width of the peripheral edge of the disc 38 received therein. Hence, disc 38 is positioned loosely within cavity 30 and can move radially. However, disc 38 is dished or flexed in the rest or closed portion thereof, as illustrated, the valve seat 22*a* extending inwardly further than the portion of the groove 30*a* against which the peripheral edge of the disc 38 bears to provide flexing of disc 38 in this position. The outer portions of the discs 38, 40, 42 and 44 are flexible and to provide rigidity in the central portions of the discs, a non-flexible insert or reinforcement member 46 is included in each of the discs 38, 40, 42 and 44. Again, referring to disc 38 as exemplary, insert 46 is retained by a spherically shaped portion 38*b* which provides a bulge or area of increased thickness in the central region of the disc 38. Inserts 46** serve to prevent warping or deformation of the discs when the discs are forced against their respective valve seats.

Considering the operation of the dosing device described above, the drawing illustrates the conditions which prevail when displacement piston 12 moves in to chamber 14, i.e., during the exhaust cycle. Under these circumstances, discs 38 and 40 are forced against their respective valves seats and hence inlet port 18 is closed off. At the same time discs 42 and 44 are lifted from their respective valve seats so that liquid can flow past the valve seats, through the apertures in disc 42 and 44, and out of exit port 20. During the intake portion of the cycle, discs 38 and 40 are lifted from their respective seats and discs 42 and 44 are forced against their respective seats to provide filling of the chamber 14. It is noted that because of the flow resistance provided by the throughholes or apertures in the discs, a servo or feedback effect is provided in the opening action of the valves formed by the discs. When the valves are opened in this manner, there are no radial tensile stresses on the discs 38, 40, 42 and 44 since these discs are not clamped at the peripheries thereof but rather can move freely in the radial direction. As a result the resistance to opening is a minimum.

In order to prevent the discs from forming a seat against the periphery of the corresponding inlet or outlet duct, the bulging or thickened portions, corresponding to portion **38*b* of disc 38, are provided with radial grooves (not shown) which allow the passage of liquid. This same result can be obtained by providing suitable projections in the area of portion 38a of disc 38** or by providing similar projections in the area surrounding the outlet ducts against which this portion of the disc moves.

Although the invention has been described relative to an exemplary embodiment thereof, it will be understood that other variations and modifications can be effected in the embodiment described without departing from the scope and spirit of the invention.

I claim:

1. A dosing device particularly adapted for dispensing small quantities of liquid, said device comprising a housing including a chamber, a variable displacement device for varying the pressure within said chamber, an inlet duct communicating with said chamber and an outlet duct communicating with said chamber, an inlet valve located within said inlet duct for controlling opening and closing of said inlet duct and an outlet valve located within said outlet duct for controlling opening and closing of said outlet duct, at least one of said valves comprising a disc having a generally circular outer periphery, and a central portion which cooperates with a corresponding valve seat formed in said housing to close off the duct associated therewith, said disc being radially moveable in an annular groove formed in said housing and in which the peripheral portion of the disc is received, said disc including at least passage therethrough spaced radially outwardly from said central portion and the thickness of the peripheral portion of said disc being less than the width of said annular groove in a direction transverse in the plane of the disc, said central portion of said disc being substantially rigid and the portion of said disc located outside of said central portion being flexible, said housing defining a cavity in which said at least one disc is located, said annular groove lying at the outer periphery of the cavity, and said valve seat extending into said cavity by an amount relative to the position of said groove to provide flexing of said disc when said disc is in the closed position thereof.

2. A dosing device as claimed in claim 1 wherein said central portion includes a rigid insert.

* * * * *